US009025974B2

(12) United States Patent
Yamamoto

(10) Patent No.: US 9,025,974 B2
(45) Date of Patent: May 5, 2015

(54) FIXING DEVICE AND IMAGE FORMATION APPARATUS

(71) Applicant: Konica Minolta, Inc., Tokyo (JP)

(72) Inventor: Naoki Yamamoto, Toyohashi (JP)

(73) Assignee: Konica Minolta, Inc., Tokyo (JP)

( * ) Notice: Subject to any disclaimer, the term of this patent is extended or adjusted under 35 U.S.C. 154(b) by 62 days.

(21) Appl. No.: 13/784,350

(22) Filed: Mar. 4, 2013

(65) Prior Publication Data

US 2013/0236199 A1 Sep. 12, 2013

(30) Foreign Application Priority Data

Mar. 8, 2012 (JP) ..... 2012-051746

(51) Int. Cl.
*G03G 15/20* (2006.01)

(52) U.S. Cl.
CPC ..... *G03G 15/2078* (2013.01); *G03G 15/2039* (2013.01); *G03G 2215/2035* (2013.01)

(58) Field of Classification Search
CPC ..... G03F 15/2057; G03F 15/55
USPC ..... 399/329
See application file for complete search history.

(56) References Cited

U.S. PATENT DOCUMENTS

| | | | | |
|---|---|---|---|---|
| 6,639,506 | B1 * | 10/2003 | Landis | 338/25 |
| 2011/0026947 | A1 * | 2/2011 | Hayamizu | 399/33 |
| 2011/0070005 | A1 * | 3/2011 | Mizumo | 399/333 |

FOREIGN PATENT DOCUMENTS

| | | |
|---|---|---|
| JP | 63-291074 | 11/1988 |
| JP | 10-319778 | 12/1998 |
| JP | 2000-155495 | 6/2000 |
| JP | 2000-188172 | 7/2000 |
| JP | 2001-328862 | 11/2001 |
| JP | 2003-347011 | 12/2003 |
| JP | 2005-119904 | 5/2005 |
| JP | 2009-109997 | 5/2009 |
| JP | 2011-248098 | 12/2011 |
| JP | 2011-253140 | 12/2011 |

OTHER PUBLICATIONS

Japanese Office Action, Decision to Grant a Patent, Patent Application No. 2012-051746, Drafting Date: Jan. 30, 2014. Mailing Date: Feb. 4, 2014 (1 page).
English translation of Japanese Office Action, Decision to Grant a Patent, Patent Application No. 2012-051746, Drafting Date: Jan. 30, 2014. Mailing Date: Feb. 4, 2014 (2 pages).

* cited by examiner

*Primary Examiner* — David Gray
*Assistant Examiner* — Sevan A Aydin
(74) *Attorney, Agent, or Firm* — Lucas & Mercanti, LLP

(57) ABSTRACT

A fixing device for thermally fixing an unfixed image on a recording sheet, comprising: a heating rotor including a cylindrical resistance heating layer, and fixing an unfixed image on a recording sheet by thermal fusion bonding using heat generated by the resistance heating layer supplied with power; a power supply unit supplying power to the resistance heating layer; an elongated heat sensitive resistor extending along an entire length of an axis of the resistance heating layer, located to face a portion of a circumferential surface of the resistance heating layer, and exhibiting a change in resistance according to a temperature of the portion of the resistance heating layer; and an abnormal heat determination unit determining whether the temperature of the portion has reached an abnormal temperature by detecting the change in resistance of the heat sensitive resistor, the abnormal temperature possibly causing damage to the resistance heating layer.

14 Claims, 11 Drawing Sheets

FIXING DEVICE AND IMAGE FORMATION APPARATUS

CROSS-REFERENCE TO RELATED APPLICATIONS

This application is based on application No. 2012-51746 filed in Japan, the contents of which are hereby incorporated by reference.

BACKGROUND OF THE INVENTION (1) Field of the Invention

The present invention relates to fixing devices provided in image formation apparatuses such as printers and copiers, and relates in particular to technology of detecting abnormal heat generated in a fixing device that utilizes a resistance heating layer as a heating element.

(2) Related Art

In recent years, fixing devices that utilize a resistance heating layer as a heating element have been commonly used as fixing devices for image formation apparatuses such as printers and copiers. The resistance heating layer generates Joule heat when supplied with power. In such a fixing device, the resistance heating layer is directly supplied with power to generate heat. Therefore, such a structure improves the heat usage efficiency and reduces the time period required for warming up.

The resistance heating layer is formed by dispersing conductive material, such as metal, in a body made of insulative material, such as heat-resistant resin. In addition, the resistance heating layer is usually coated with an insulative layer, since direct contact with the layer may cause electric shock. For example, Japanese Patent Application Publication No. 2009-109997 discloses a fixing device utilizing a resistance heating layer coated with an insulative layer, which serves as a heating element.

Meanwhile, since the insulative layer is very thin (e.g. on the order of several hundred micrometers), the insulative layer may be damaged due to entrance of foreign objects or contact with recording sheets. If the damage reaches the resistance heating layer, particularly in the event of the occurrence of a flaw in a non-parallel direction to the current flow (in particular, the perpendicular direction to the current flow), the current will detour around the flaw and be concentrated at the edges of the flaw. As a result, the current density locally increases in areas around the edges of the flaw. This leads to abnormal heat generated in the areas with the locally-increased high current density in the resistance heating layer.

Such abnormal heat, if left without any treatment, may damage the fixing device, and can be a cause of overheating of the fixing device or catching fire. Therefore, it is necessary to detect the occurrence of abnormal heat without overlooking it, and when the abnormal heat is detected, it is necessary to prevent further damage to the fixing device by taking a necessary measure such as cutting off the power supply to the fixing device.

A fixing device is provided with temperature detector elements such as a thermistor and a thermostat. However, the detection range of such temperature detector elements is usually narrow. Therefore, there is a problem that the occurrence of abnormal heat in the resistance heating layer is overlooked, depending on the location of the abnormal heat.

Several approaches can be conceived of as solutions to this problem. For example, the number of temperature detector elements may be increased to cover the entire surface of the resistance heating layer. It is also possible to configure the temperature detector elements to be movable, and detect the temperature of the entire surface of the resistance heating layer by moving the temperature detector elements.

These approaches expand the range of the abnormal heat detection by the temperature detector elements, and reduce the frequency of overlooking the occurrence of abnormal heat.

However, the first approach above has a following problem. That is, since the number of temperature detector elements that can be provided is limited in light of reduction of the manufacturing cost, it is difficult to sufficiently expand the detection range of the abnormal heat, and it is therefore difficult to sufficiently increase the detection sensitivity of the abnormal heat.

The second approach is also problematic, because it takes a long time to move the temperature detector elements across the entire surface of the resistance heating layer, and accordingly the period of the detection cycle at each detection point will be long. That is, when abnormal heat occurs, it takes a long time before detecting it. It is therefore impossible to promptly take a necessary measure when abnormal heat occurs, and the damage to the fixing device could progress during this delay.

SUMMARY OF THE INVENTION

To solve the problems described above, one aspect of the present invention provides 1. A fixing device for thermally fixing an unfixed image on a recording sheet, comprising: a heating rotor including a cylindrical resistance heating layer, and configured to fix an unfixed image on a recording sheet by thermal fusion bonding using heat generated by the resistance heating layer, the resistance heating layer generating heat when supplied with power; a power supply unit configured to supply power to the resistance heating layer; a heat sensitive resistor having an elongated shape extending along an entire length of an axis of the resistance heating layer, located to face a portion of a circumferential surface of the resistance heating layer, and configured to exhibit a change in resistance according to a temperature of the portion of the resistance heating layer; and an abnormal heat determination unit configured to determine whether the temperature of the portion of the resistance heating layer has reached an abnormal temperature by detecting the change in resistance of the heat sensitive resistor, the abnormal temperature possibly causing damage to the resistance heating layer.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings.

DESCRIPTION OF PREFERRED EMBODIMENTS

The following describes an embodiment of an image formation apparatus pertaining to the present invention, based on an example case in which the apparatus is adopted in a tandem color digital printer (hereinafter simply referred to as "printer").

[1] Structure of Printer

Figure 1:
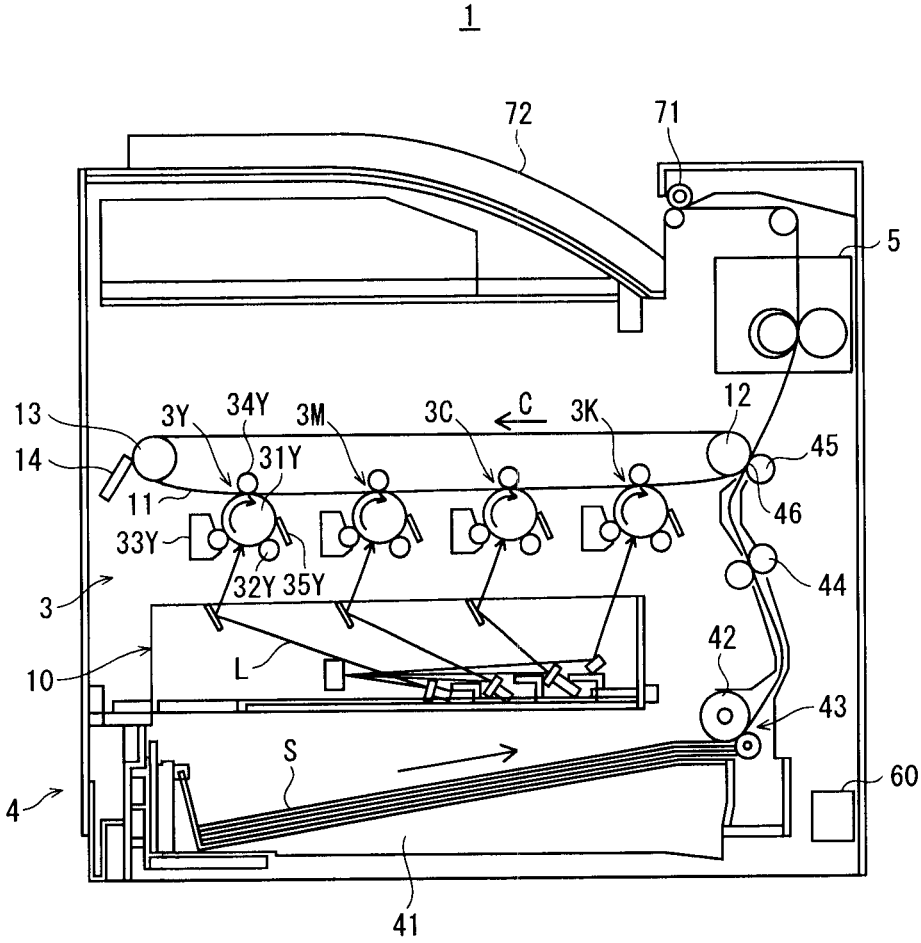
FIG. 1 shows the structure of a printer 1.

First, a printer 1 pertaining to the embodiment is described. FIG. 1 shows the structure of the printer 1 pertaining to the embodiment. As shown in the figure, the printer 1 includes an image processing unit 3, a paper feeder 4, a fixing device 5 and a control unit 60.

The printer 1 is connected to a network (e.g. LAN). Upon receiving a print instruction from an external terminal apparatus (not depicted) or from an operation panel (not depicted), the printer 1 performs printing to a recording sheet according to the instruction, by forming toner images of the respective colors of yellow, magenta, cyan and black, and sequentially transferring the toner images to form a full-color image.

In the following description, the reproduction colors of yellow, magenta, cyan, and black are denoted as "Y", "M", "C" and "K", respectively, and any structural component related to one of the reproduction colors is denoted by a reference sign attached with an appropriate subscript "Y", "M", "C" or "K".

The image processing unit 3 includes image creating units 3Y, 3M, 3C, and 3K, an exposing unit 10, an intermediate transfer belt 11 and a secondary transfer roller 45, for example.

Since the image creating units 3Y, 3M, 3C and 3K have the same structure, the following mainly describes the structure of the image creating unit 3Y.

The image creating unit 3Y includes a photosensitive drum 31Y and also includes a charger 32Y, a developer 33Y, a primary transfer roller 34Y, and a cleaner 35Y, which are disposed about the photosensitive drum 31Y. The cleaner 35Y is provided for cleaning the photosensitive drum 31Y. The image creating unit 3Y forms a yellow toner image on the photosensitive drum 31Y. The developer 33Y faces the photosensitive drum 31Y, and transports charged toner to the photosensitive drum 31Y.

The intermediate transfer belt 11 is an endless belt wound around a drive roller 12 and a passive roller 13 in taut condition to rotatably run in the direction indicated by the arrow C. A cleaner 14 for removing toner remaining on the intermediate transfer belt 11 is provided near the passive roller 13. The exposing unit 10 is provided with a light-emitting element such as a laser diode, and emits a laser beam L for forming images of the Y, M, C and K colors according to the drive signal from control unit 60, in order to expose-scan the photosensitive drums of the image creating units 3Y, 3M, 3C and 3K.

By the expose-scanning, an electrostatic latent image is formed on the photosensitive drum 31Y charged by the charger 32Y. Similarly, an electrostatic latent image is formed on each of the photosensitive drums of the image creating units 3M, 3C and 3K. The electrostatic latent images formed on the photosensitive drums are developed by the respective developers of the image creating units 3Y, 3M, 3C and 3K. As a result, toner images are formed on the photosensitive drums in the corresponding colors.

The toner images thus formed are subject to primary transfer by the respective primary transfer rollers of the image creating units 3Y, 3M, 3C and 3K, by which the toner images are transferred onto precisely the same position on the surface of the intermediate transfer belt 11 with appropriately adjusted timing (Note that, in FIG. 1, only the primary transfer roller corresponding to the image creating unit 3Y is given the reference sign 34Y, and the other primary transfer rollers are not given a reference sign). After the primary transfer, the toner images on the intermediate transfer belt 11 are subject to secondary transfer, by which the toner images are collectively transferred onto a recording sheet due to the effect of electrostatic force caused by the secondary transfer roller 45. The recording sheet, on which the toner images are transferred by the secondary transfer, is further transported to the fixing device 5. The toner images (unfixed images) on the recording sheet are thermally fixed on the recording sheet by heat and pressure applied by the fixing device 5, and ejected onto a catch tray 72 by an ejection roller 71.

A paper feed section 4 includes for example: a paper feed cassette 41 for storing recording sheets (indicated by the sign S in FIG. 1); a pickup roller 42 that picks up a recording sheet S from the paper feed cassette 41 one sheet at a time and feeds the recording sheet S onto a transport path 43; and a pair of timing rollers 44 that adjusts the timing to transport the fed recording sheet S to a second transfer position 46. It is not necessary that only one paper feed cassette is provided. The paper feed section 4 may include a plurality of paper feed cassettes.

As the recording sheets, sheets of paper (standard paper, thick paper) with different sizes and film sheets such as OHP sheets may be used. When there are a plurality of paper feed cassettes, each paper feed cassette may contain recording sheets with a different size, thickness, or material.

The rollers, such as the pickup rollers 42 and the timing rollers 44, are rotated by the power transmission mechanism such as gear wheels and belts (not depicted) driven by a transport motor (not depicted). The transport motor is, for example, a stepping motor whose rotation speed can be controlled accurately.

The recording sheet is transported from the paper feed section 4 to the second transfer position 46 in synchronization with transportation of the toner images on the intermediate transfer belt 11, and the toner images on the intermediate transfer belt 11 are collectively transferred onto the recording sheet by the secondary transfer roller 45.

[2] Structure of Fixing Device

Figure 2:
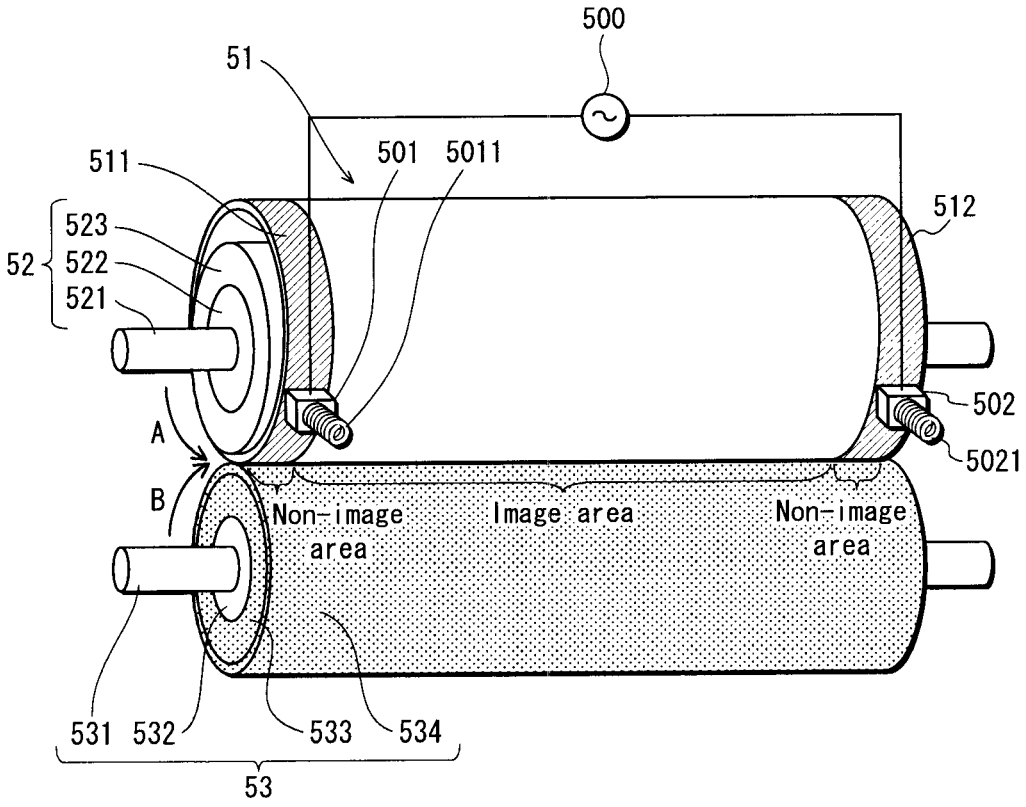
FIG. 2 is a perspective view showing an external structure of a fixing device 5.

FIG. 2 is a perspective view showing an external structure of the fixing device 5. As shown in the figure, the fixing device 5 includes: a heating rotor 51; a fixing roller 52; a pressure roller 53; a power source unit 500 which applies voltage to both ends of the heating rotor 51 (i.e. to a resistance heating layer 513 described below); and a power supply members 501 and 502 which supply power to the heating rotor 51 (i.e. to electrodes 511 and 512 described below).

The heating rotor 51 is an endless belt, and the ends thereof are provided with the electrodes 511 and 512. These electrodes are supplied with voltage from the power source unit 500 via the power supply members 501 and 502. The power supply members are, for example, power supply brushes (e.g. carbon brush of copper graphite, carbon graphite, or the like) or power supply rollers. Due to power supply from the power supply members, electrical current flows between the electrodes, and thus the heating rotor 51 generates Joule heat.

The heating rotor 51 is also provided with a temperature sensor (not depicted). The temperature sensor is located at a predetermined position near the outer circumferential surface of the heating rotor 51 (for example, in the vicinity of the midpoint in the axial direction). The temperature sensor detects the temperature of the outer circumferential surface of the heating rotor 51. According to the temperature detected by the temperature sensor, the control unit 60 controls power supply from the power source unit 500 to the heating rotor 51, and thereby controls the temperature of the heating rotor 51 so that the temperature of the outer circumferential surface of the heating rotor 51 will be the fixing temperature (e.g. 180° C.).

Figure 3:
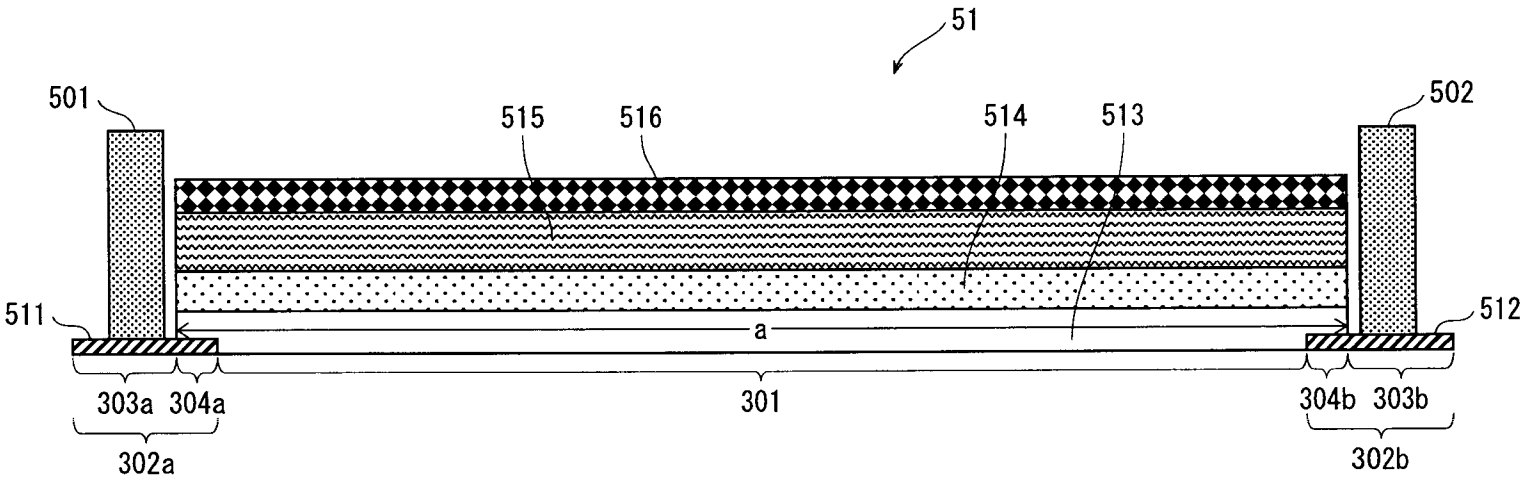
FIG. 3 is a cross-sectional view showing a detailed structure of a heating rotor 51.

FIG. 3 is a cross-sectional view showing a detailed structure of the heating rotor 51. As shown in the figure, in the image area indicated by the sign 301, the heating rotor 51 is composed of a resistance heating layer 513, a reinforcing layer 514, an elastic layer 515 and a releasing layer 516, which are layered in the stated order. Here, the term "image area 301" means an area on the heating rotor 51 expanding in the width direction (the axial direction) of the belt and corresponding to the area where the images on the recording sheet pass through. The same applies to the image area shown in FIG. 2.

In the layer structure described above, the reinforcing layer 514 may be the lowermost layer, and the resistance heating layer 513, the elastic layer 515 and the releasing layer 516 may be layered on the reinforcing layer 514 in the stated order.

The resistance heating layer 513 generates Joule heat when supplied with power from the power source unit 500 via the electrodes 511 and 512. The resistance heating layer 513 is formed by dispersing fiber-like, needle-like or flake-like conductive fillers on or inside a heat-resistant resin. The sign a shown in FIG. 3 indicates the length of the resistance heating layer 513 in the axial direction.

Examples of the heat-resistant resin used for the resistance heating layer 513 include polyimide resin, polyethylene sulfide resin, polyether ether ketone resin, polyaramide resin, polysulfone resin, polyimide amide resin, polyester imide resin, polyphenylene oxide resin, poly-p-xylylene resin, polybenzImidazole resin. Particularly, it is desirable to use polyimide resin, because polyimide resin is advantageous in terms of thermal resistance, insulation properties, mechanical strength, and so on.

Examples of the conductive fillers include metal such as silver (Ag), copper (Cu), aluminum (Al), magnesium (Mg) and nickel (Ni), carbon nanotube, carbon nanofiber, and carbon microcoil. It is also possible to combine two or more types of conductive fillers (e.g. carbon nanofiber and metal).

It is desirable that the conductive fillers are fiber-like, needle-like or flake-like in order to increase the possibility that the fillers will be tangled and have many contact points. Fillers having such a shape allow the resistance heating layer 513 to have uniform electrical resistance.

The thickness of the resistance heating layer 513 may be determined freely, but preferably falls within the range of 5 μm to 100 μm. The volume resistivity of the resistance heating layer 513 can be set within the range of $1.0\times10^{-6}$ Ω·m to $9.9\times10^{-3}$ Ω·m, but preferably set within the range of $1.0\times10^{-5}$ Ω·m to $5.0\times10^{-3}$ Ω·m.

The reinforcing layer 514 is a layer for reinforcing the resistance heating layer 513. For example, polyimide resin may be used. The thickness of the reinforcing layer 514 can be determined freely, but preferably falls within the range of 5 μm to 150 μm. The elastic layer 515 is a layer for uniformly and flexibly conducting heat to the toner images on the recording sheet. The elastic layer 515 prevents the toner images from being flattened out or ununiformly fused, and consequently prevents the occurrence of image noises. The elastic layer 515 is made from heat-resistant elastic material such as rubber and resin. For example, heat-resistant elastomer such as silicone rubber or fluoro rubber may be used.

The thickness of the elastic layer 515 falls within the range of range of 10 μm to 800 μm, preferably within the range of 50 μm to 300 μm. When the elastic layer 515 has a thickness less than 10 μm, it is difficult for the elastic layer 515 to have sufficient elasticity in the thickness direction. When the elastic layer 515 has a thickness greater than 800 μm, heat generated by the resistance heating layer 513 does not easily reach the outer circumferential surface of the heating rotor 51 and exhibits poor thermal conductivity. This is not desirable.

The releasing layer 516 is the outermost layer of the heating rotor 51, and is provided to increase the release characteristics of the heating rotor 51 so that the heating rotor 51 easily releases the recording sheet. The releasing layer is made from a material that is durable under the use at the fixing temperature and that has excellent release characteristics so as to easily release toner. For example, fluoro resin such as PFA (tetrafluoroethylene-perfluoroalkylvinylether copolymer), PTFE (polytetrafluoroethylene), FEP (tetrafluoroethylene-hexafluoroethylene copolymer), or PFEP (tetrafluoroethylene-hexafluoropropylene copolymer) may be used. The thickness of the releasing layer 516 falls within the range of 5 μm to 100 μm, preferably within the range of 10 μm to 50 μm.

In the non-image areas at both ends, which are indicated by signs 302*a* and 302*b* in FIG. 3, the heating rotor 51 has exposed portions indicated by the signs 303*a* and 303*b*, and overlapping portions indicated by the signs 304*a* and 304*b*.

Here, the term "non-image areas 302*a* and 302*b*" means areas on the heating rotor 51 expanding in the width direction of the belt and corresponding to the areas where the images on the recording sheet do not pass through. The same applies to the non-image areas shown in FIG. 2.

In the exposed portions 303*a* and 303*b*, the respective single layers of the electrodes 511 and 512 are exposed. In the overlapping portions 304*a* and 304*b*, the electrodes 511 and 512 are coated with the resistance heating layer 513, and thus the resistance heating layer 513 overlaps the electrodes 511 and 512. Furthermore, the reinforcing layer 514, the elastic layer 515 and the releasing layer 516 are layered in the stated order on the resistance heating layer 513 overlapping the electrodes 511 and 512.

Alternatively, in the non-image areas 302*a* and 302*b*, the reinforcing layer 514 may be the lowermost layer of the heating rotor 51, and the resistance heating layer 513 and the electrode 511 or 512 may be layered on the reinforcing layer 514 in the stated order.

The electrodes 511 and 512 are made of conductive material. Examples of the material of the electrodes include metal such as gold (Au), silver (Ag), copper (Cu), aluminum (Al), zinc (Zn), tungsten (W), nickel (Ni), stainless-steel (SUS), brass and phosphor bronze, and it is desirable to use metal with low volume resistivity, high thermal resistance and high oxidation resistance, such as nickel, stainless steel and aluminum. Although it is desirable that the electrodes are thick for high rigidity and high resistance to damage, thick electrodes do not easily deform at the fixing nip formed by the pressure member. Considering the valance between the rigidity and the flexibility, it is desirable that the thickness falls within the range of 10 μm to 100 μm, and more preferably within the range of 30 μm to 70 μm.

Returning to FIG. 2, the power supply members 501 and 502 are provided with biasing members 5011 and 5021 respectively, which press the power supply members 501 and 502 toward the inside of the running path of the heating rotor 51. Examples of the biasing members 501 and 502 include a compression spring. Due to the pressure applied by the biasing members 5011 and 5021, the power supply members 501 and 502 are pressed against the exposed portions 303*a* and 303*b* of the electrodes 511 and 512, respectively.

The fixing roller 52 and the pressure roller 53 are attached to core bars 522 and 532 respectively, and end portions 521 and end portions 531 of the core bars 522 and 532 in the axial direction are rotably supported by bearings of a frame which is not depicted in the drawing. The pressure roller 53 is rotated in the direction indicated by the arrow B due to the drive force from the drive motor (not depicted). As the pressure roller 53 is rotated, the heating rotor 51 and the fixing roller 52 are rotated by the pressure roller 53 in the direction indicated by the arrow A.

The fixing roller 52 is formed by coating the surface of the core bar 522 having an elongated cylindrical shape with a heat-insulating layer 523. The fixing roller 52 is disposed inside the running path of the heating rotor 51, and the length thereof in the axial direction (i.e. the length not including the lengths of the end portions 521 supported by the bearings) is longer than the distance between the contact points on the exposed portions 303*a* and 303*b* of the heating rotor 51 with the power supply members 501 and 502 corresponding to the electrodes 511 and 512. The core bar 522 supports the fixing roller 52, and is made of material with thermal resistance and strength. The core bar 522 is made of, for example, aluminum, steel, or stainless steel.

The heat-insulating layer 523 prevents heat generated by the heating rotor 51 from conducting to the core bar 522. The material of the heat-insulating layer 523 preferably is a sponge-like structure (heat insulative structure) made of a rubber material or a resin material having low thermal conductivity and having thermal resistance and elasticity. This is because such a material gives the heating rotor 51 flexibility and widens the nip. The heat-insulating layer 523 may be formed to have two layers of a solid structure and a sponge structure. When a silicon sponge is used as the heat-insulating layer 523, the thickness thereof preferably falls within the range of 1 mm to 10 mm, and more preferably falls within the range of 2 mm to 7 mm.

The pressure roller 53 is formed by layering the releasing layer 534 on the surface of the core bar 532 having a cylindrical shape, with the elastic layer 533 intervened between the core bar 532 and the releasing layer 534. The pressure roller 53 is disposed outside the running path of the heating rotor 51, and presses against the fixing roller 52 from the outer circumferential surface of the heating rotor 51 so as to form a fixing nip between the pressure roller 53 and the outer circumferential surface of the heating rotor 51. The fixing nip is formed to have a predetermined width in the rotation direction of the heating rotor 51.

The core bar 532 supports the pressure roller 53, and made up from a material with thermal resistance and strength. The core bar 532 is made of, for example, aluminum, steel, or stainless steel. The elastic layer 533 is made of elastic, heat-resistant material such as silicone rubber or fluoro rubber, and has the thickness falling within the range of 1 mm to 20 mm. The releasing layer 534, similarly to the releasing layer 516, increases the release characteristics of the pressure roller 53 so that the pressure roller 53 easily releases the recording sheet. The material and the thickness of the releasing layer 534 can be determined under the conditions described above as for the releasing layer 516.

Figure 4:
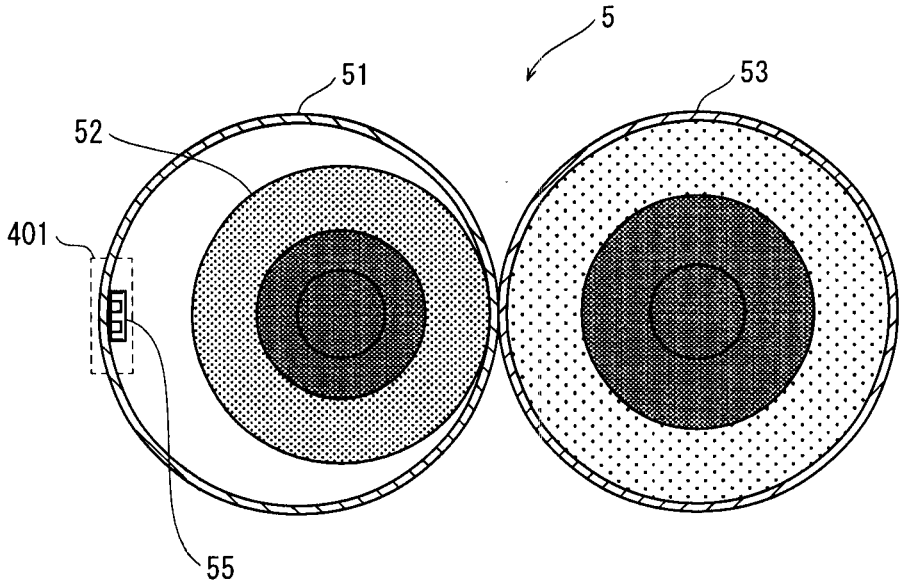
FIG. 4 is a cross-sectional view showing an internal structure of the fixing device 5.

FIG. 4 is a cross-sectional view showing the internal structure of the fixing device 5. A heat sensitive resistor 55 is disposed in the space between the heating rotor 51 and the fixing roller 52 of the fixing device 5 so that the heat sensitive resistor 55 is in contact with the inner circumferential surface of the belt of the heating rotor 51.

Figure 5:
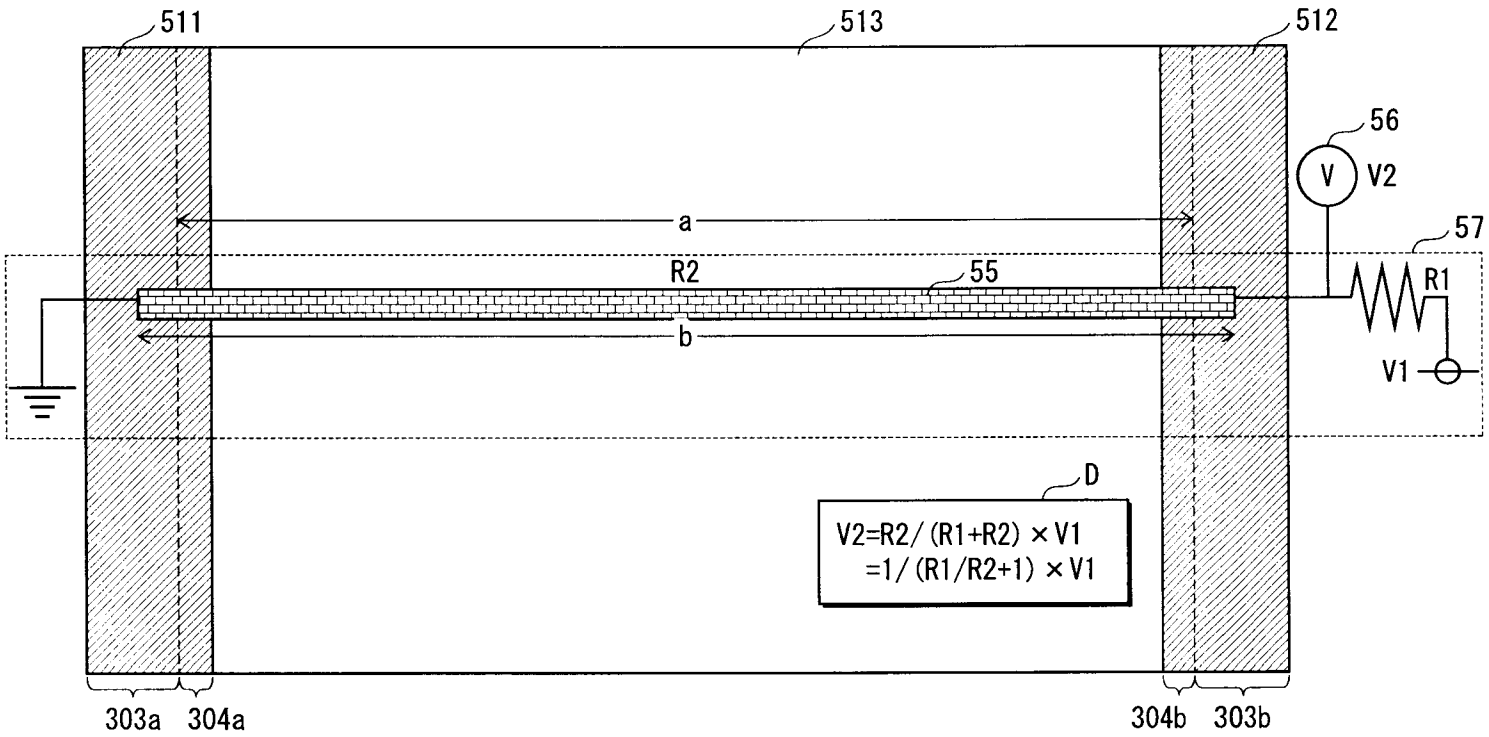
FIG. 5 is an exploded view of the portion indicated with a dotted rectangle 401 (the portion in the vicinity of a contact area of the heating rotor 51 and a heat sensitive resistor 55) shown in FIG. 4.

FIG. 5 is an exploded view of the portion indicated with the dotted rectangle 401 (the portion in the vicinity of the contact area of the heating rotor 51 and the heat sensitive resistor 55) shown in FIG. 4. The sign a in the drawing, as in FIG. 3, indicates the length in the axial direction of the resistance heating layer 513 of the heating rotor 51, and the sign b indicates the length in the lengthwise direction of the heat sensitive resistor 55. The signs 303*a* and 303*b* in the drawing correspond to the exposed portions shown in FIG. 3, and the signs 304*a* and 304*b* correspond to the overlapping portions shown in FIG. 3. The signs 511 and 512 indicate the electrodes. As shown in FIG. 5, the resistance heating layer 513 extends to the overlapping portions 304*a* and 304*b* in the axial direction of the heating rotor 51.

The heat sensitive resistor 55 has an elongated shape, and is fixed to the device so that, in the lengthwise direction, the heat sensitive resistor 55 is in contact with the entire length of the resistance heating layer 513 in the axial direction, and in the widthwise direction of the main surface thereof, the heat sensitive resistor 55 is in contact with a portion of the circumferential surface of the resistance heating layer 513. The length b of the heat sensitive resistor 55 in the lengthwise direction is longer than the length a of the heat sensitive resistor 55 in the axial direction of the resistance heating layer 513 (b>a). The resistance heating layer 513 is rotated by the rotation of the heating rotor 51, whereas the heat sensitive resistor 55 is fixed to the device. During each rotation of the heating rotor 51, the entire surface of the resistance heating layer 513 is brought into contact with the heat sensitive resistor 55 having the elongated shape.

Figure 6:
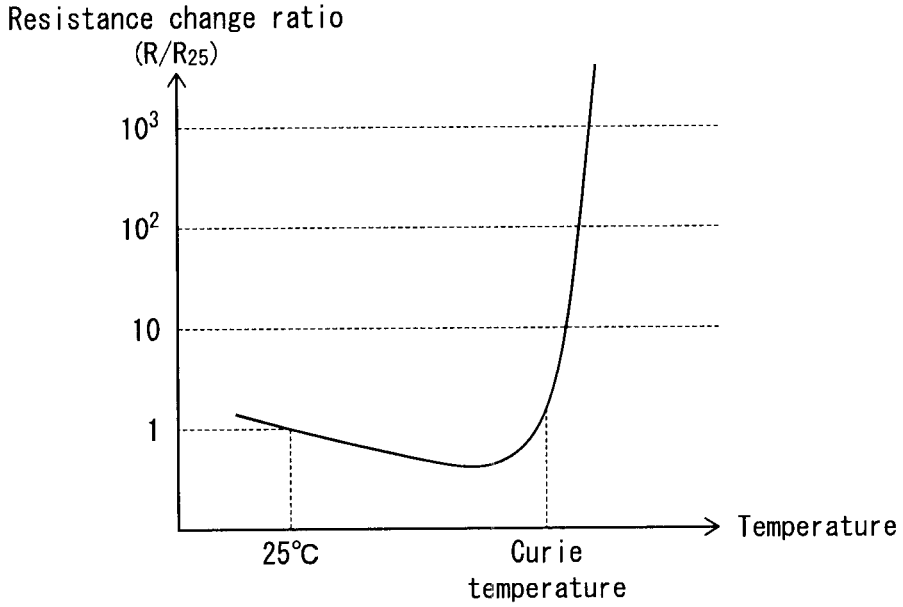
FIG. 6 shows example PTC characteristics of a barium titanate ($BaTiO_3$) based semiconductor ceramic composition.

The heat sensitive resistor 55 is made from a Barium titanate ($BaTiO_3$) based semiconductor ceramic composition. The heat sensitive resistor 55 has a Curie point and exhibits positive temperature coefficient (PTC) characteristics with which the electrical resistance of the heat sensitive resistor 55 sharply increases at the Curie point (Curie temperature). FIG. 6 shows example PTC characteristics of a barium titanate ($BaTiO_3$) based semiconductor ceramic composition.

The vertical axis shows the rate of change in the resistance (resistance change rate) and the horizontal axis shows the temperature. The resistance change rate is represented by $R/R_{25}$, where $R_{25}$ denotes the resistance (volume resistivity) of the semiconductor ceramic composition at the room temperature (25° C.) and R denotes the resistance (volume resistivity) of the semiconductor ceramic composition at a given temperature. As shown in the figure, the semiconductor ceramic composition exhibits the PTC characteristics. That is, the change rate of its electrical resistance is greater at or above the Curie temperature than in the temperature range below the Curie temperature, and, at or above the Curie temperature, the electrical resistance sharply increases according to the temperature rise.

The Curie temperature of barium titanate ($BaTiO_3$) based semiconductor ceramic composition is approximately 120° C., but by adding other metal elements to the semiconductor ceramic composition, it is possible to raise or lower the Curie temperature. For example, addition of strontium (Sr) or calcium (Ca) lowers the Curie temperature, and addition of lead (Pb) raises the Curie temperature.

Thus, it is possible to obtain a semiconductor ceramic composition with a desired Curie temperature by changing the type and amount of the additional metal elements. For example, as disclosed in Japanese Patent Application Publication No. 2001-328862 (Table 1, Table 2 and FIG. 4), it has been known that the Curie temperature of a barium titanate ($BaTiO_3$) based semiconductor ceramic composition is raised (to be in the range of 250° C. to 490° C.) by replacing 20 mol % to 90 mol % of its barium (Ba) with lead (Pb).

According to the present embodiment, some of the barium (Ba) component contained in the barium titanate ($BaTiO_3$) based semiconductor ceramic composition is replaced with lead (Pb) (e.g. 20 mol % to 30 mol % of barium (Ba) is replaced with lead (Pb)), and the Curie temperature of the heat sensitive resistor 55 is adjusted to fall within the range of 250° C. to 300° C.

The Curie temperature of the heat sensitive resistor 55 is adjusted according to the abnormal heat temperature of the resistance heating layer 513. Here, the term "abnormal heat temperature" means a temperature that could damage the components of the fixing device 5. In the following description, it is assumed that the abnormal heat temperature falls within the range of 250° C. to 300° C. The abnormal heat temperature is a temperature determined by the manufacturer in advance according to the thermal resistance of the components of the fixing device 5. Therefore, the abnormal heat temperature should not be limited to the above-described range, and the Curie temperature may be adjusted according to the abnormal heat temperature.

The components of fixing devices commonly used in recent years are made of material that is not thermally damaged until the temperature reaches approximately 250° C. to 300° C. Considering this fact, the inventor of the present invention sets the abnormal heat temperature and the Curie temperature of the resistance heating layer 513 so as to fall within the range of 250° C. to 300° C. Note that the Curie temperature is set lower than the abnormal heat temperature, considering the radiation of heat during the conduction from the resistance heating layer 513 to the heat sensitive resistor 55.

Furthermore, it is preferable that the abnormal heat temperature is set to 250° C. or higher, in order to prevent misdetection of the abnormal heat by distinguishing the abnormal heat caused by damages on the resistance heating layer 513 from a temperature rise in the resistance heating layer 513 due to an excessive temperature rise in the non-sheet conveyance region occurring during thermal fixing of images onto a small recording sheet.

The Curie temperature is adjusted to be the temperature supposed to be reached by the heat sensitive resistor 55 when a portion of the resistance heating layer 513 at the abnormal heat temperature is located to face the heat sensitive resistor 55 and conducts heat to the heat sensitive resistor 55. Specifically, the Curie temperature is set lower than the abnormal heat temperature by the amount of heat radiated during the conduction from the resistance heating layer 513 to the heat sensitive resistor 55.

To determine the Curie temperature, the manufacturer measures in advance the temperature reached by the heat sensitive resistor 55 when the resistance heating layer 513 as a whole reaches the abnormal heat temperature. The manufacturer can set the Curie temperature according to the measurement result. Alternatively, the Curie temperature may be determined by changing the temperature of the resistance heating layer 513 to be given temperatures, obtaining the differences in temperature between the resistance heating layer 513 and the heat sensitive resistor 55 corresponding to the given temperatures of the resistance heating layer 513, and then calculating the difference in temperature between the resistance heating layer 513 and the heat sensitive resistor 55 when the temperature of the resistance heating layer 513 reaches the abnormal heat temperature, based on the obtained differences. That is, the Curie temperature may be set to the value obtained by subtracting the calculated difference from the abnormal heat temperature.

It will be possible to detect the abnormal heat by setting the Curie temperature as described above, because when the resistance heating layer 513 reaches the abnormal heat temperature, the temperature of the heat sensitive resistor 55 reaches the Curie temperature, and the electrical resistance of the heat sensitive resistor 55 thereafter sharply increases.

Returning to FIG. 5, the heat sensitive resistor 55 (the resistor R2 in FIG. 5) is connected to the resistor R1 in serial to form a voltage-dividing circuit 57 for generating output voltage V2 that is in proportion to input voltage V1. V2 can be obtained by the formula indicated by sign D in FIG. 5 ($V2=R2/(R1+R2)\times V1$). As can be seen from the formula, V2 increases as the resistance of the heat sensitive resistor 55 (R2) increases. Therefore, it is possible to detect changes in the electrical resistance of the heat sensitive resistor 55 by monitoring V2. The value of the resistor R1 can be determined freely, but it is preferably equal to or greater than the value of the resistor R2 at the room temperature, but not greater than double the value of the resistor R2 at the room temperature.

The value of voltage V2, which is measured by the voltage detector 56 at any portion of the resistance heating layer 513 where the heat sensitive resistor 55 can face, is monitored by the control unit 60. Abnormal heat generated in the resistance heating layer 513 is detected through an abnormal heat detection process, which will be described later.

Figure 7:
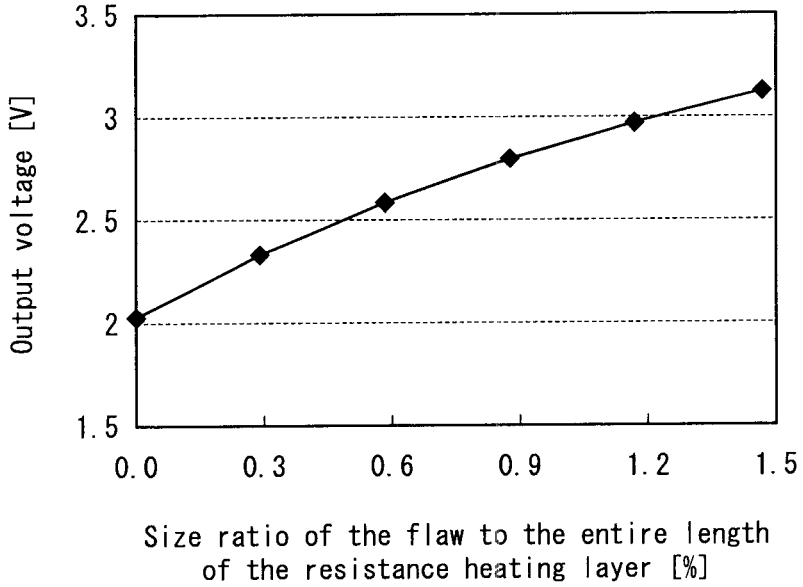
FIG. 7 shows test results on the relationship among the values of output voltage V2 measured in a normal case where abnormal heat does not occur in a resistance heating layer 513 and abnormal cases where abnormal heat occurs in the resistance heating layer 513.

FIG. 7 shows test results on the relationship among the values of output voltage V2 measured in a normal case where abnormal heat does not occur in the resistance heating layer 513 and abnormal cases where abnormal heat occurs in the resistance heating layer 513. The test was conducted as for each of the case where the resistance heating layer 513 is not damaged and the cases where the resistance heating layer 513 is damaged, by detecting the value of output voltage V2 by using the fixing device 5.

Specifically, the test was conducted as for the case where the resistance heating layer 513 is not damaged and the cases where the resistance heating layer 513 has a flaw (abnormally hot portion) in different sizes (lengths). The ratio (percentage) of the sizes (lengths) of the flaw, measured in the axial direction, to the entire length of the resistance heating layer 513 in the axial direction were 0.3%, 0.6%, 0.9%, 1.2% and 1.5%. For each case, the value of output voltage V2 was detected when the surface temperature (measured in an area outside the vicinity of the edges of the flaw) of the heating rotor 51 reaches the fixing temperature (approximately 180° C.). In the test, V1=5V, R1=500Ω, and R2 (measured at room temperature)=340Ω.

As shown in the drawing, in all the cases where the resistance heating layer 513 has a flaw and generates abnormal heat, the value of output voltage V2 is greater than in the case where the resistance heating layer 513 does not has a flaw and does not generate abnormal heat. Furthermore, the value of output voltage V2 increases as the size of the flaw increases.

Even in view of an measurement error (e.g. approximately 0.5 V) made by the voltage detector 56, the resistance heating layer 513 with a flaw having a length no less than 0.6% exhibits a change in the value of V2 by more than 0.5 V from the value of V2 in the resistance heating layer 513 without a flaw. Thus, it was observed that the sensitivity of detection of the abnormal heat is satisfactory when the length of the flaw is 0.6% or more.

Figure 8:
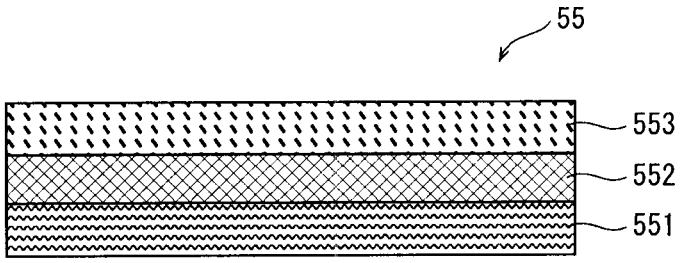
FIG. 8 shows an example structure of the heat sensitive resistor 55.

FIG. 8 shows an example structure of the heat sensitive resistor 55. As shown in the drawing, the heat sensitive resistor 55 is made up of a reinforcing layer 551, a detection layer 552 and an insulative layer 553 layered in the stated order. The reinforcing layer 551 is a layer for reinforcing the detection layer 552, and is made of insulative material such as ceramic.

The detection layer 552 is a layer for detecting abnormal heat generated in the resistance heating layer 513, and is made of a barium titanate ($BaTiO_3$) based semiconductor ceramic composition in which some of barium (Ba) has been replaced with lead (Pb) so that its Curie temperature falls within the range of 250° C. to 300° C.

The insulative layer 553 is a layer for protecting the detection layer 552 from wearing due to friction and securing insulation between the detection layer 552 and the resistance heating layer 513. The insulative layer 533 is made by ceramic coating or glass coating.

As described above, in the fixing device 5, the entire surface of the resistance heating layer 513 is brought into contact with the heat sensitive resistor 55 having the elongated shape during each rotation of the heating rotor 51. Therefore, the fixing device 5 can inspect the entire surface of the resistance heating layer 513 for abnormal heat by monitoring changes in the electrical resistance of the heat sensitive resistor 55. This leads to increase in the sensitivity of the detection of the abnormal heat, and the fixing device 5 can inspect the entire surface of the resistance heating layer 513 for abnormal heat during such a short period as the period of one rotation.

Desirably, the heat sensitive resistor 55 used for the abnormal heat detection is thin (e.g. thin film) so as to increase the responsivity to the heat generated by the resistance heating layer 513, and is as short as possible in the widthwise direction of the main surface so as to reduce its thermal capacity.

[3] Structure of Control Unit

Figure 9:
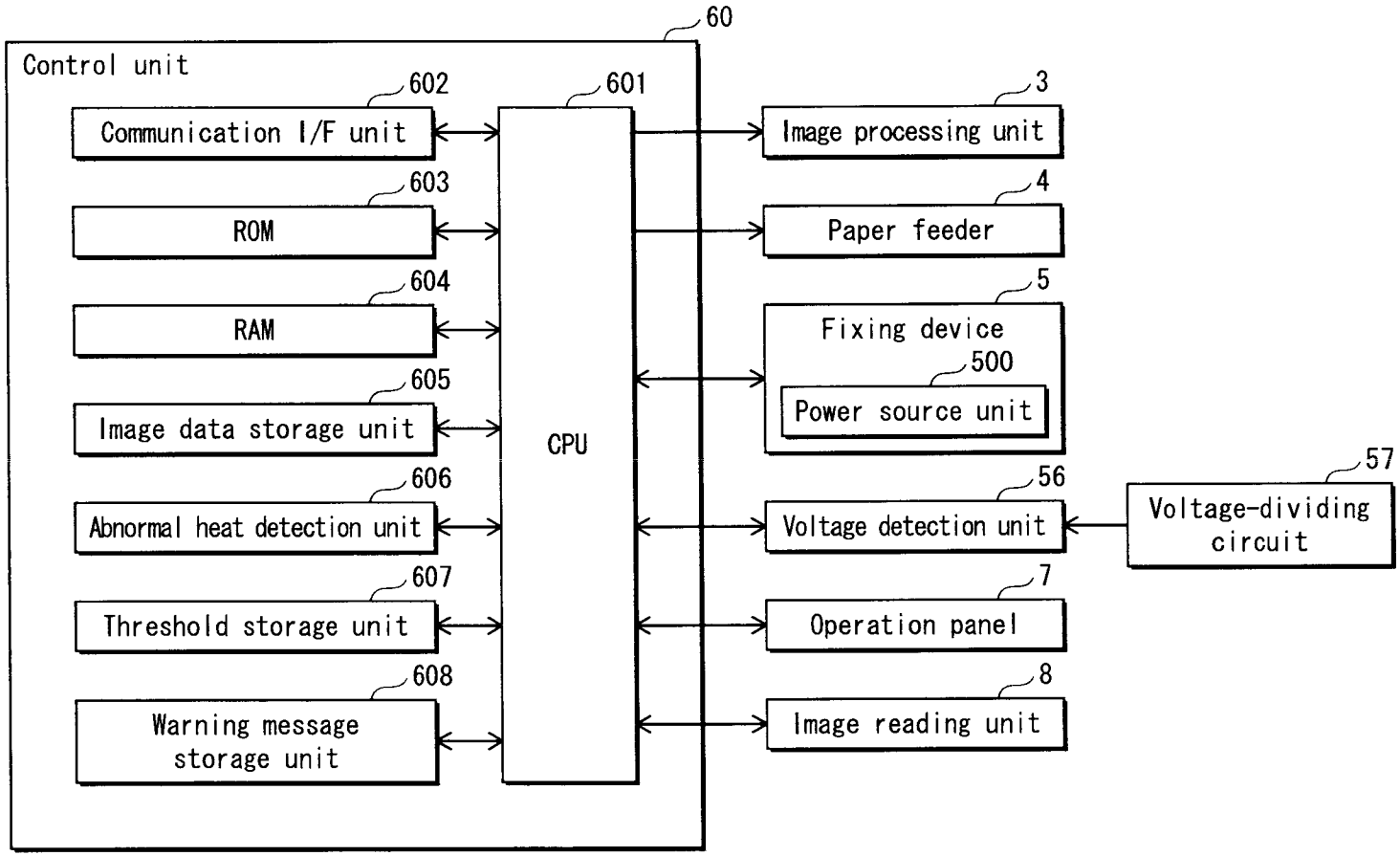
FIG. 9 shows the structure of the control unit 60, and the relationship with primary elements under the control of the control unit 60.

FIG. 9 shows the structure of the control unit 60 and the relationship with primary elements under the control of the control unit 60. The control unit 60 is a computer, and includes, as shown in the drawing, a CPU (Central Processing Unit) 601, a communication interface (I/F) unit 602, a ROM (Read Only Memory) 603, a RAM (Random Access Memory) 604, an image data storage unit 605, an abnormal heat detection unit 606, a threshold storage unit 607 and a warning message storage unit 608, for example.

The communication I/F unit 602 is an interface for connecting to the LAN, such as a LAN card and a LAN board. The ROM 603 stores, for example, a program for controlling the image processing unit 3, the paper feeder 4, the fixing device 5, the voltage detection unit 56, the operation panel 7, the image reading unit 8 and so on, and a program for controlling the abnormal heat detection performed during the processes of the warming up and execution of a print job. These processes will be described later. The CPU 601 controls the image processing unit 3, the paper feeder 4, the fixing device 5, the voltage detection unit 56, the operation panel 7, the image reading unit 8, and so on, and furthermore, executes the abnormal heat detection during the warming up and during the execution of a print job.

The RAM 604 is used as a work area when the CPU 601 executes programs. The image data storage unit 605 stores image data for printing, which has been input from the communication I/F unit 602 or the image reading unit 8. The abnormal heat detection unit 606 receives, from the voltage detection unit 56, the results of the detection of the output voltage V2 from the voltage-dividing circuit 57. When the received value of V2 is equal to or greater than the abnormal heat threshold stored in the threshold storage unit 607, the abnormal heat detection unit 606 determines that abnormal heat is generated in the resistance heating layer 513.

Here, the term "abnormal heat threshold" means the value of the output voltage V2 from the voltage-dividing circuit 57 when the temperature of the heat sensitive resistor 55 reaches the Curie temperature. This is when a portion of the surface of the resistance heating layer 513, where the temperature has reached the abnormal heat temperature due to a flaw, faces the heat sensitive resistor 55 due to the rotation of the heating rotor 51. The temperature of the heat sensitive resistor 55 rises due to the heat conducted from the portion of the surface of the resistance heating layer 513. For example, using the test results shown in FIG. 7, it is possible to set the abnormal heat threshold to approximately 2.6 V, which is the value of V2 when the size of the flaw in the resistance heating layer 513 is 0.6%.

The threshold storage unit 607 stores the abnormal heat threshold. The warning message storage unit 608 stores data for displaying a warning message indicating the occurrence of abnormal heat.

The voltage detection unit 56 includes a voltmeter, for example, and detects the output voltage V2 from the voltage-dividing circuit 57 and outputs the results to the control unit 60. The operation panel 7 includes a plurality of input keys and a liquid crystal display unit. A touch panel is layered on the surface of the liquid crystal display unit. The operation panel 7 receives a user instruction issued by touch or key-in from the input keys, and sends the instruction to the control unit 60. The image reading unit 8 includes an image input device such as a scanner. The image reading unit 8 reads information on a recording sheet, such as characters and figures, and forms image data.

[4] Abnormal Heat Detection

Figure 10:
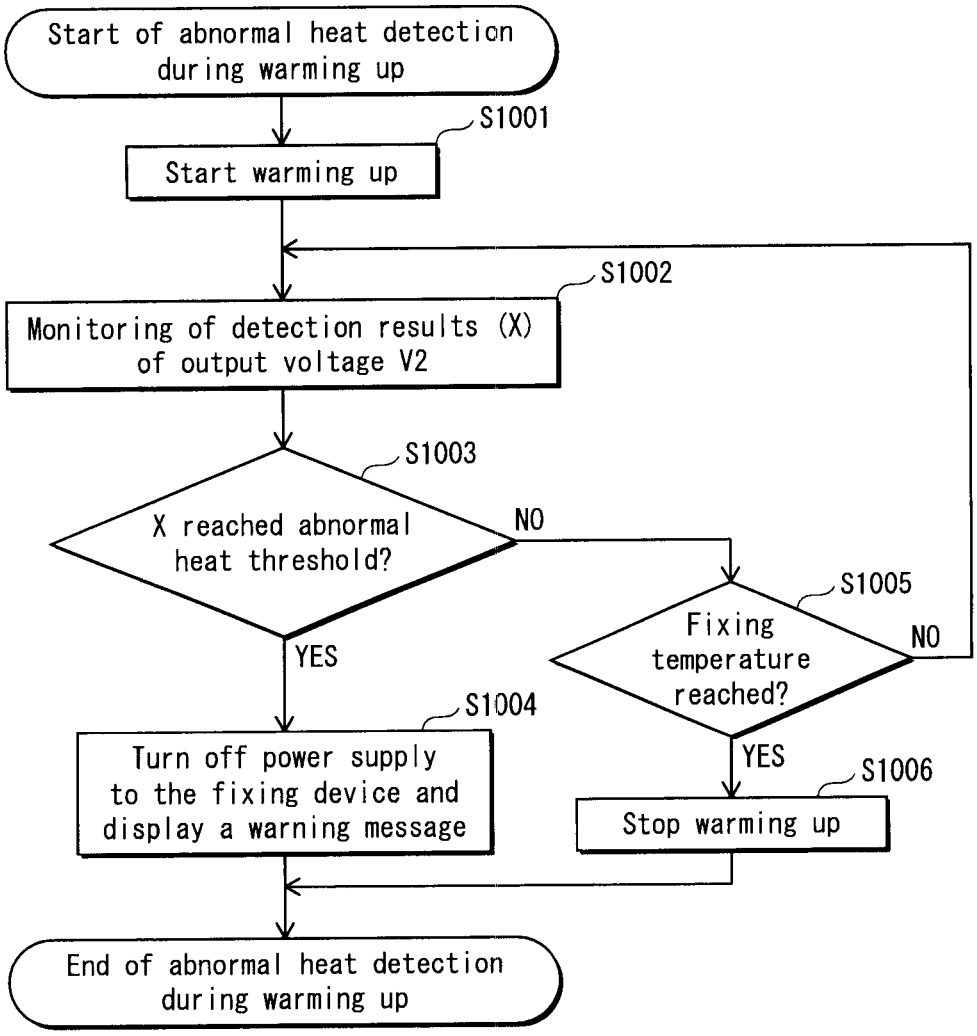
FIG. 10 is a flowchart showing abnormal heat detection performed by the control unit 60 during warming up of the fixing device 5.

The following describes the abnormal heat detection performed by the control unit 60. FIG. 10 is a flowchart showing the abnormal heat detection performed by the control unit 60 during the warming up of the fixing device 5.

The control unit 60 starts warming up the fixing device 5 (Step S1001) when the printer 1 is powered on or when a print instruction is input by the user via the operation panel 7 and the communication I/F unit 602 while the printer 1 is not being supplied with power (e.g. sleep mode). The control unit 60 performs the warming up by driving the drive motor for the pressure roller 53 so that the heating rotor 51 is rotated by the pressure roller 53, and supplying power to the heating rotor 51 from the power source unit 500.

Next, the control unit 60 monitors the detection result (X) of the output voltage V2 notified by the voltage detection unit 56 as for any portion of the resistance heating layer 513 where the heat sensitive resistor 55 can face, for a predetermined period (at least for the period of one rotation of the resistance heating layer 513) (Step S1002), and determines whether or not the value of X has reached the abnormal heat threshold stored in the threshold storage unit 607 (Step S1003).

When determining that the value of X at any portion of the surface of the resistance heating layer 513 has reached the abnormal heat threshold (Step S1003: YES), the control unit 60 stops the drive motor for the pressure roller 53 and thereby stops the heating rotor 51 being rotated by the pressure roller 53, stops the power supply to the power source unit 500 of the fixing device 5, and displays a warning message based on the data stored in the warming message storage unit 608, indicating the occurrence of the abnormal heat, on the liquid crystal display unit of the operation panel 7 (Step S1004).

When determining that the value of X has not reached the abnormal heat threshold in Step S1003 (Step S1003: NO), the control unit 60 monitors the temperature detected by the temperature sensor located near the outer circumferential surface of the heating rotor 51, and determines whether the temperature has reached the fixing temperature (e.g. 180° C.) (Step S1005). When determining that the temperature has reached the fixing temperature (Step S1005: YES), the control unit 60 stops warming up the fixing device 5 and controls the power supply from the power source unit 500 to keep the surface temperature of the outer circumferential surface of the heating rotor 51 at the fixing temperature (Step S1006). When determining that the temperature has not reached the fixing temperature (Step S1005: NO), the control unit 60 subsequently performs Step S1002.

Figure 11:
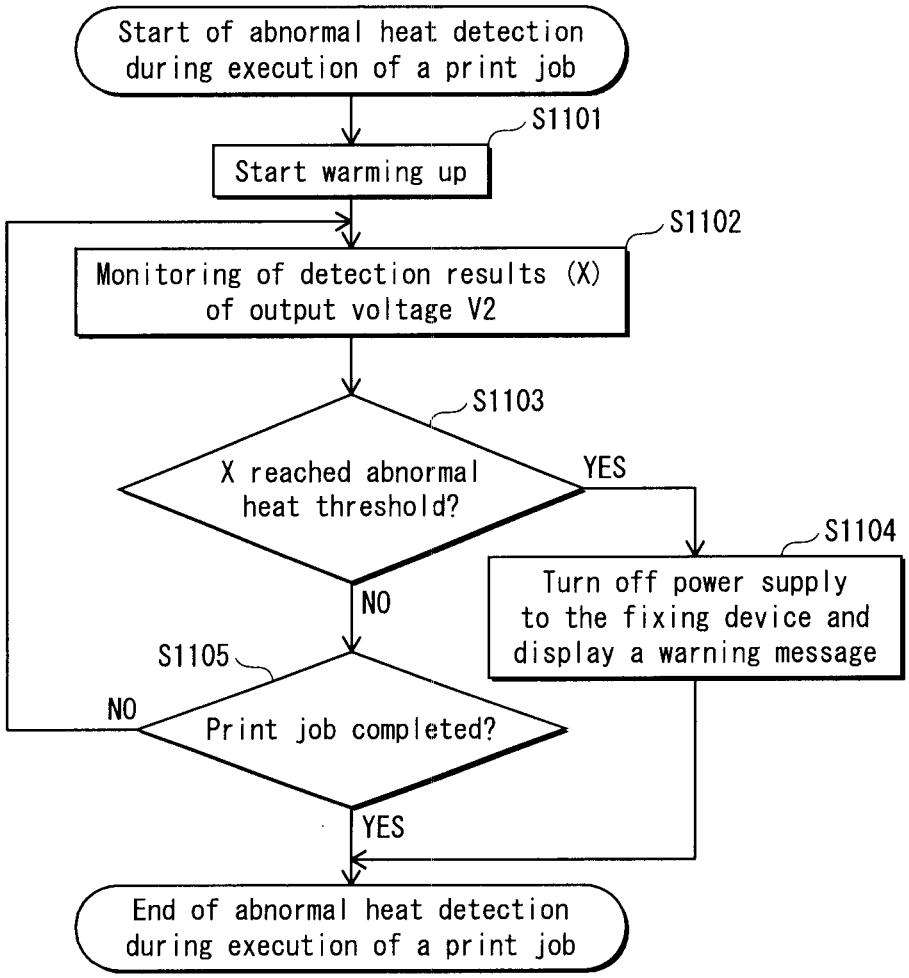
FIG. 11 is a flowchart showing abnormal heat detection performed during execution of a print job.

The following describes the abnormal heat detection performed by the control unit 60 during execution of a print job. FIG. 11 is a flowchart showing the operations therefor. The control unit 60 starts a print job when receiving a print instruction from a user via the operation panel 7 or the communication I/F unit 602, and the warming up of the fixing device 5 has been completed (When the surface temperature of the outer circumferential surface of the heating rotor 51 has reached the fixing temperature) (Step S1101). The control unit 60 monitors the detection result (X) of the output voltage V2 notified by the voltage detection unit 56 as for any portion of the surface of the resistance heating layer 513 where the heat sensitive resistor 55 can face (Step S1102), and determines whether or not the value of X has reached the abnormal heat threshold stored in the threshold storage unit 607 (Step S1103).

When determining that the value of X for any portion of the surface of the resistance heating layer 513 has reached the abnormal heat threshold (Step S1103: YES), the control unit 60, as with the case shown in FIG. 10, stops the heating rotor 51 being rotated by the pressure roller 53, stops the power supply to the power source unit 500 of the fixing device 5, and displays a warning message based on the data stored in the warming message storage unit 608, indicating the occurrence of the abnormal heat, on the liquid crystal display unit of the operation panel 7 (Step S1104). When determining that the value of X has not reached the abnormal heat threshold (Step S1103: NO), the control unit 60 repeats Steps S1102 and S1103 until the print job completes (Step S1105: YES).

As described above, in the printer 1 pertaining to the present embodiment, the occurrence of abnormal heat can be detected from any point on the entire surface of the resistance heating layer 513 where the heat sensitive resistor 55 can face. Therefore, it is possible to increase the sensitivity of the detection of the abnormal heat by forming the heat sensitive resistor 55 to be as small as possible (i.e. shorten the width of the main surface as much as possible) so that the occurrence of abnormal heat can be detected from every tiny portion of the resistance heating layer 513.

Furthermore, since the entire surface of the resistance heating layer 513 is inspected to detect abnormal heat during one rotation of the resistance heating layer 513, it takes only a short time to inspect the entire surface to detect abnormal heat.

Furthermore, since the Curie temperature of the heat sensitive resistor 55 is adjusted to correspond to the abnormal heat temperature of the resistance heating layer 513, the printer 1 can quickly detect the abnormal heat generating in the resistance heating layer 513 by detecting a sharp change in the electrical resistance of the heat sensitive resistor 55 when the temperature of the heat sensitive resistor 55 reaches the Curie temperature due to the abnormal heat of the resistance heating layer 513. This makes it possible to take a necessary measure to prevent the progression of heat damage to the fixing device 5, for example by stopping power supply to the resistance heating layer 513.

Modifications

The present invention has been described above based on an embodiment. However, the present invention is not limited to the embodiment. The following modifications are acceptable.

Figure 12A:
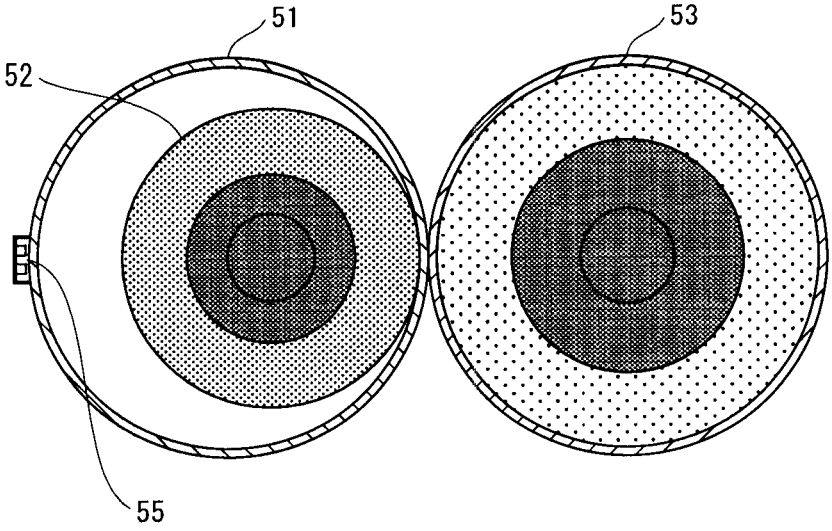
FIGS. 12A and 12B show modification examples of the arrangement of the heat sensitive resistor 55.
Figure 12B:
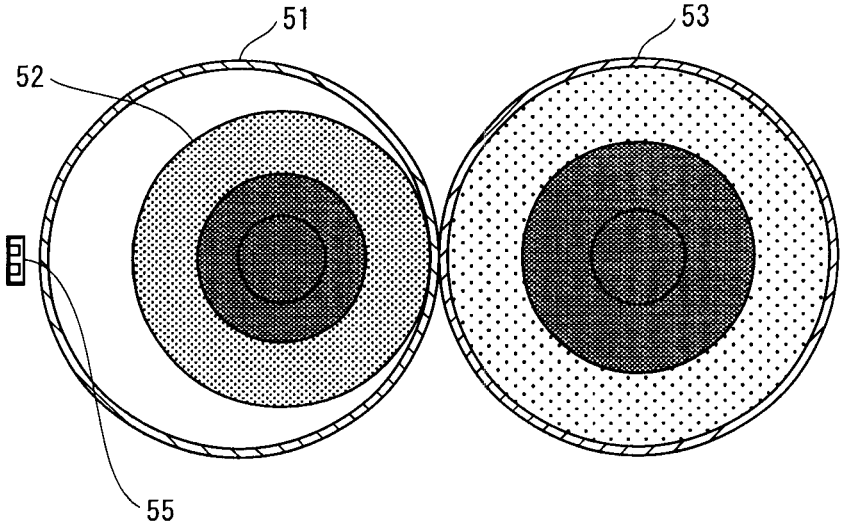

(1) In the present embodiment, the heat sensitive resistor 55 is located to be in contact with the inner circumferential surface of the heating rotor 51. However, this is not essential. For example, the heat sensitive resistor 55 may be located to be in contact with the outer circumferential surface of the heating rotor 51 as shown in FIG. 12A, or may be located near the heating rotor 51. In FIG. 12A and FIG. 12B, the sign "51" indicates the heating rotor, the sign "52" indicates the pressure roller, and the sign "55" indicates the heat sensitive resistor.

In every case, as with the embodiment described above, the heat sensitive resistor 55 has an elongated shape, and is arranged such that, in the lengthwise direction, the heat sensitive resistor 55 is in contact with or extends along the entire length of the resistance heating layer 513 in the axial direction, and in the widthwise direction of the main surface, the resistance heating layer 513 is in contact with or faces a portion of the circumferential surface of the resistance heating layer 513. The length of the heat sensitive resistor 55 is set longer than the length of the resistance heating layer 513 in the axial direction.

When the heat sensitive resistor 55 is not in contact with the heating rotor 51 as shown in FIG. 12B, the insulative layer 553 of the heat sensitive resistor 55 is not necessary.

In the embodiment described above, the heating rotor 51 is an endless belt. However, the heating rotor 51 may be a heating roller made up of the belt and the fixing roller 52 integrated together. If this is the case, since the heat sensitive resistor 55 cannot be located inside the heating rotor 51, the heat sensitive resistor 55 is located as shown in FIG. 12A or FIG. 12B, so that the device can quickly detect abnormal heat generated in the resistance heating layer with desirable detection sensitivity, as with the case of the embodiment.

When the heat sensitive resistor 55 is located so as not to be in contact with the heating rotor 51 as shown in FIG. 12B, the responsivity to the heat generated by the resistance heating layer 513 is slightly degraded. However, such an arrangement is advantageous in that there is no risk of wear of the surface of the heating rotor 51 or degradation of the quality of the image to be thermally fixed. The heat sensitive resistor 55 is also prevented from wearing and being degraded.

(2) In the embodiment described above, the heat sensitive resistor 55 is made from a resistor having PTC characteristics with which the electrical resistance sharply increases at or above the Curie temperature. However, the heat sensitive resistor 55 is not limited to a resistor having PTC characteristics, and any types of resistance may be used so long as it exhibits a change in resistance according to the temperature.

For example, the heat sensitive resistor 55 may be made from a resistor having negative temperature coefficient (NTC) characteristics with which the electrical resistance sharply decreases at or above the Curie temperature.

With such a resistor, since its electrical resistance changes at or above the Curie temperature, the printer 1 can detect abnormal heat generated in the resistance heating layer 513 by detecting the change in resistance in the same manner as with the case of a resistor having PTC characteristics. Examples of the material of a resistor having NTC characteristics include bismuth oxide based ceramics (c.f. Paragraphs 0008 and 0009 of Japanese Patent Application Publication No. 2005-119904).

The Curie temperature of bismuth oxide based ceramics can be adjusted by changing the among of replacement of the element A in the composition represented by $(Bi_2O_2)^{2+}(A_{-1}B_nO_{3n+1})^{2-}$. The element A can be selected from Ca, Ba, Sr, Pb and Bi, and the element B can be selected from Ti, Nb and Ta.

For example, by setting the composition of the heat sensitive resistor 55 to be $Sr_2Bi_4Ti_5O_{18}$, the heat sensitive resistance 55 will be a resistor having NTC characteristics whose Curie temperature is 285° C.

(3) In the embodiment described above, abnormal heat generated by the resistance heating layer 513 is detected by detecting the output voltage V2 from the voltage-dividing circuit 57. However, the abnormal heat generated by the resistance heating layer 513 may be detected by directly detecting the resistance of the heat sensitive resistor 55. Specifically, the abnormal heat of the resistance heating layer 513 may be detected by determining whether the value of resistance of the resistance heating layer 513 has reached the value supposed to be reached when the resistance heating layer 513 generates abnormal heat.

The value supposed to be reached when the resistance heating layer 513 generates abnormal heat is determined beforehand by the manufacturer through a test or the likes.

<Summary>

One aspect of the present invention pertaining to the embodiment described above provides 1. A fixing device for thermally fixing an unfixed image on a recording sheet, comprising: a heating rotor including a cylindrical resistance heating layer, and configured to fix an unfixed image on a recording sheet by thermal fusion bonding using heat generated by the resistance heating layer, the resistance heating layer generating heat when supplied with power; a power supply unit configured to supply power to the resistance heating layer; a heat sensitive resistor having an elongated shape extending along an entire length of an axis of the resistance heating layer, located to face a portion of a circumferential surface of the resistance heating layer, and configured to exhibit a change in resistance according to a temperature of the portion of the resistance heating layer; and an abnormal heat determination unit configured to determine whether the temperature of the portion of the resistance heating layer has reached an abnormal temperature by detecting the change in resistance of the heat sensitive resistor, the abnormal temperature possibly causing damage to the resistance heating layer.

The heat sensitive resistor may exhibit a greater resistance change rate at or above a Curie temperature thereof than in a temperature range below the Curie temperature, and the Curie temperature may be set at a temperature supposed to be reached by the heat sensitive resistor when the temperature of the resistance heating layer reaches the abnormal temperature.

The abnormal temperature may fall within a range of 250° C. to 300° C. The heat sensitive resistor may exhibit positive temperature coefficient (PTC) characteristics at or above the Curie temperature.

The heat sensitive resistor may exhibit negative temperature coefficient (NTC) characteristics at or above the Curie temperature. The heat sensitive resistor may be made from a thin film.

The heating rotor may be a rotatable endless belt. The heat sensitive resistor may be located such that a surface thereof is in contact with the circumferential surface of the belt. The circumferential surface of the belt may be opposite a surface of the belt on which the recording sheet passes. The heat sensitive resistor may include: an insulative layer; and a detection layer that exhibits a change in resistance according to a temperature thereof, wherein the insulative layer of the heat sensitive resistor may be in contact with the circumferential surface of the belt.

Another aspect of the present invention provides an image formation apparatus provided with the fixing device described above.

With any of the stated structures, it is easy to determine whether the temperature of the resistance heating layer has reached the abnormal heat temperature, which might cause damage to the resistance heating layer, by detecting a change in resistance of the heat sensitive resistor having an elongated shape extending along the entire length of the resistance heating layer and located to face a portion of the circumferential surface of the resistance heating layer, since the resistance of the heat sensitive resistor changes according to the temperature of the portion of the resistance heating layer.

During each rotation of the resistance heating layer, the heat sensitive resistor having an elongated shape, which faces a portion of the circumferential surface of the resistance heating layer, can inspect the entire circumferential surface of the resistance heating layer for abnormal heat. Thus, the fixing device stated above improves the sensitivity of the abnormal heat detection, and takes only a short time to inspect the entire circumferential surface of the resistance heating layer for abnormal heat.

The power supply unit may stop supplying power to the resistance heating layer when the resistance heating layer reaches the abnormal temperature.

With this structure, the fixing device can effectively prevent the progression of damage to the fixing device after the occurrence of the abnormal heat.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

The invention claimed is:

1. A fixing device for thermally fixing an unfixed image on a recording sheet, comprising:

a heating rotor including a cylindrical resistance heating layer, and configured to fix an unfixed image on a recording sheet by thermal fusion bonding using heat generated by the resistance heating layer, the resistance heating layer generating heat when supplied with power and configured to rotate with the heating rotor in a rotation direction relative to the fixing device;

a power supply unit configured to supply power to the resistance heating layer;

a heat sensitive resistor having an elongated shape extending along an entire length of an axis of the resistance heating layer, located to face a portion of a circumferential surface of the resistance heating layer, and configured to exhibit a change in resistance according to a temperature of the portion of the resistance heating layer, the heat sensitive resistor being fixed with respect the fixing device; and an abnormal heat determination unit configured to determine whether the temperature of the portion of the resistance heating layer has reached an abnormal temperature by detecting the change in resistance of the heat sensitive resistor, the abnormal temperature possibly causing damage to the resistance heating layer.

2. The fixing device of claim 1, wherein the heat sensitive resistor exhibits a greater resistance change rate at or above a Curie temperature thereof than in a temperature range below the Curie temperature, and the Curie temperature is set at a temperature supposed to be reached by the heat sensitive resistor when the temperature of the resistance heating layer reaches the abnormal temperature.

3. The fixing device of claim 1, wherein the abnormal temperature falls within a range of 250° C. to 300° C.

4. The fixing device of claim 2, wherein the heat sensitive resistor exhibits positive temperature coefficient (PTC) characteristics at or above the Curie temperature.

5. The fixing device of claim 2, wherein the heat sensitive resistor exhibits negative temperature coefficient (NTC) characteristics at or above the Curie temperature.

6. The fixing device of claim 1, wherein the heat sensitive resistor is made from a thin film.

7. The fixing device of claim 1, wherein the heating rotor is a rotatable endless belt.

8. The fixing device of claim 7, wherein the heat sensitive resistor is located such that a surface thereof is in contact with the circumferential surface of the belt.

9. The fixing device of claim 8, wherein the circumferential surface of the belt is opposite a surface of the belt on which the recording sheet passes.

10. The fixing device of claim 8, wherein the heat sensitive resistor includes:

an insulative layer; and a detection layer that exhibits a change in resistance according to a temperature thereof, wherein the insulative layer of the heat sensitive resistor is in contact with the circumferential surface of the belt.

11. The fixing device of claim 1, wherein the power supply unit stops supplying power to the resistance heating layer when the resistance heating layer reaches the abnormal temperature.

12. The fixing device of claim 1, wherein the heat sensitive resistor and the resistance heating layer are configured so that during each rotation of the resistance heating layer with the heating roller, an entire surface of the resistance heating layer is brought into contact with heat sensitive resistor.

13. An image formation apparatus comprising:

a fixing device for thermally fixing an unfixed image on a recording sheet, the fixing device including:

a heating rotor including a cylindrical resistance heating layer, configured to fix an unfixed image on a recording sheet by thermal fusion bonding using heat generated by the resistance heating layer, the resistance heating layer generating heat when supplied with power and configured to rotate with the heating rotor in a rotation direction relative to the fixing device;

a power supply unit configured to supply power to the resistance heating layer;

a heat sensitive resistor having an elongated shape extending along an entire length of an axis of the resistance heating layer, located to face a portion of a circumferential surface of the resistance heating layer, and configured to exhibit a change in resistance according to a temperature of the portion of the resistance heating layer, the heat sensitive resistor being fixed with respect the fixing device; and an abnormal heat determination unit configured to determine whether the temperature of the portion of the resistance heating layer has reached an abnormal temperature by detecting the change in resistance of the heat sensitive resistor, the abnormal temperature possibly causing damage to the resistance heating layer.

14. The image formation apparatus of claim 13, wherein the heat sensitive resistor and the resistance heating layer are configured so that during each rotation of the resistance heating layer with the heating roller, an entire surface of the resistance heating layer is brought into contact with heat sensitive resistor.

* * * * *